United States Patent [19]

Smith

[11] Patent Number: 4,872,666

[45] Date of Patent: Oct. 10, 1989

[54] SKIPPING ROPE ASSEMBLY

[76] Inventor: Kristin S. Smith, 509 Poppy Hill Rd., Watsonville, Calif. 95076

[21] Appl. No.: 167,539

[22] Filed: Mar. 14, 1988

Related U.S. Application Data

[63] Continuation-in-part of Ser. No. 902,611, Sep. 2, 1986, abandoned.

[51] Int. Cl.[4] ..... A63B 5/20

[52] U.S. Cl. ..... 272/75; 272/143; 220/282; 273/81.2; 403/165; 16/114 B; 24/115 R; 74/543

[58] Field of Search ..... 272/74, 75, 68, DIG. 4; 220/284; 215/207, 215, 302; 273/81 R, 81 B, 81 C, 81.2, 73 J; 294/171, 902, 152; 383/13; 403/164, 165; 16/40 R, 114 R, 114 B; 24/115 R; 124/20 R; 74/543, 551.9

[56] References Cited

U.S. PATENT DOCUMENTS

| | | | |
|---|---|---|---|
| 633,590 | 9/1899 | Hinkson et al. | 272/75 |
| 1,044,742 | 11/1912 | Carnes | 220/284 |
| 1,609,063 | 11/1926 | Closson | 220/284 |
| 3,149,747 | 9/1964 | Burgess | 220/284 X |
| 3,212,777 | 10/1965 | Spoczynski | 272/75 |
| 3,419,270 | 12/1968 | Eppy | 272/75 |
| 3,778,053 | 12/1973 | Smith et al. | 272/75 |

FOREIGN PATENT DOCUMENTS

| | | | |
|---|---|---|---|
| 2444477 | 8/1980 | France | 272/75 |
| 601946 | 5/1948 | United Kingdom | 272/75 |

*Primary Examiner*—Richard J. Apley
*Assistant Examiner*—David J. Bender
*Attorney, Agent, or Firm*—Flehr, Hohbach, Test, Albritton & Herbert

[57] ABSTRACT

A skipping rope assembly of a type particularly useful by small children or handicapped people attempting to learn how to coordinate movements required for skipping rope includes a relatively stiff elongate skipping element which carries handles on its opposite ends. The handles are readily removable so they can be opened to permit the ends of the skipping element to be adjusted lengthwise therein, thereby adjusting the length of the exposed portion of the skipping element defined between the handles.

2 Claims, 2 Drawing Sheets

SKIPPING ROPE ASSEMBLY

This is a continuation-in-part application of copending application Ser. No. 902,611, filed Sept. 2, 1986, and entitled Skipping Rope Assembly now abandoned.

FIELD OF THE INVENTION

This invention relates to improvements in skipping ropes such as are used by children for playing and exercising and more particularly to a skipping rope assembly constructed in a manner which facilitates reinforcement of learning to skip rope.

BACKGROUND OF THE INVENTION

One of the major problems in learning to jump rope for little children has been observed to be the fact that the learner has trouble maintaining the arc formed by the rope element overhead and that it collapses downwardly onto the user. Therefore, as disclosed herein, the rope element has been made to be sufficiently "semi-rigid" or "stiff" whereby when the ends are held in the hands of the user with the rope formed in an arc held stationary overhead of the user, the element will maintain its arcuate form. Therefore, the jump "rope" will make it much easier for little children to learn the sequence of jump rope skills while eliminating the problem of maintaining an arc with respect to steady momentum. These skills are:

1. The ability to jump over an object with both feet;
2. The ability to turn an object around the body with both arms;
3. The ability to coordinate the first and second steps noted above; and
4. Adding rhythm to the above.

Thus, the terms "semi-rigid" and "stiff" as used herein are deemed to mean a material wherein with the two forearms and handles held substantially parallel to the floor, the plane of the arc of the rope element remains substantially parallel to the floor, with substantially no sag at the remote end or tip of the arc.

The "rope" element has sufficient flexibility whereby it can be bent into an arcuate configuration without creating a substantial load on the hands of the user. For example, a hollow tubular plastic rope element approximately six feet long by $\frac{3}{8}$ inch outside diameter can be readily wound into two loops by a child of five.

SUMMARY OF THE INVENTION AND OBJECTS

In general, there is provided a skipping rope assembly having an elongate skipping element. The element is characterized as being relatively stiff as defined above so as to provide greater control for a person trying to use the assembly. Handles carried at the opposite ends of the element are attached in a manner permitting the element to rotate within and with respect to the handles as the skipping element is swung around the user. The handles comprise a pair of elongate shell portions formed with means for readily releasably retaining the two shell portions together to form a hollow handle.

In general, it is an object of the present invention to provide a skipping rope assembly which makes it easier for little children or others to use the assembly at an earlier age or under move difficult conditions.

It is another object of the invention to provide a skipping rope assembly characterized by a "stiff" elongate skipping element as defined above carrying readily removable handles at each end in a manner permitting the ends of the element to rotate within the handles.

It is yet another object of the invention to provide novel readily removable handles at the ends of a skipping element.

The foregoing and other objects of the invention will become more readily evident from the following detailed description of a preferred embodiment when considered in conjunction with the drawings:

DETAILED DESCRIPTION OF A PREFERRED EMBODIMENT

An improved skipping rope assembly 10 includes an elongate skipping element 11 preferably formed of a hollow tubular material such as a length of PVC pipe having an outer diameter on the order of $\frac{3}{8}''$ and a length of approximately $6\frac{1}{2}'$. The skipping element is "semi-rigid" or "stiff" as defined above.

Figure 2:
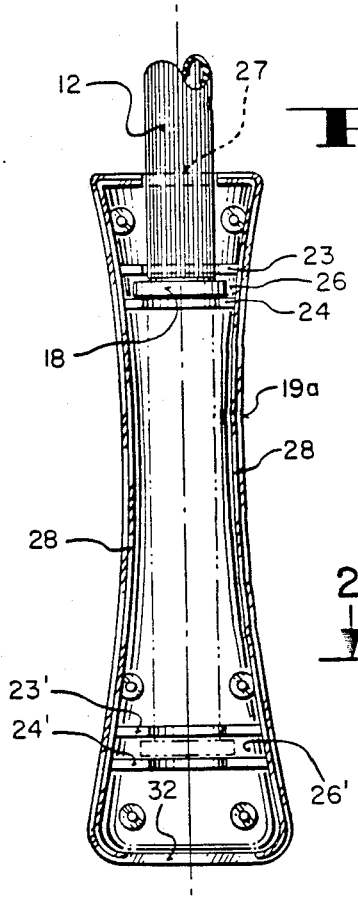
FIG. 2 shows a plan view taken along the line 2—2 of FIG. 3 showing the interior construction of a portion of the handle assembly used in the skipping rope assembly of FIG. 1.
Figure 3:
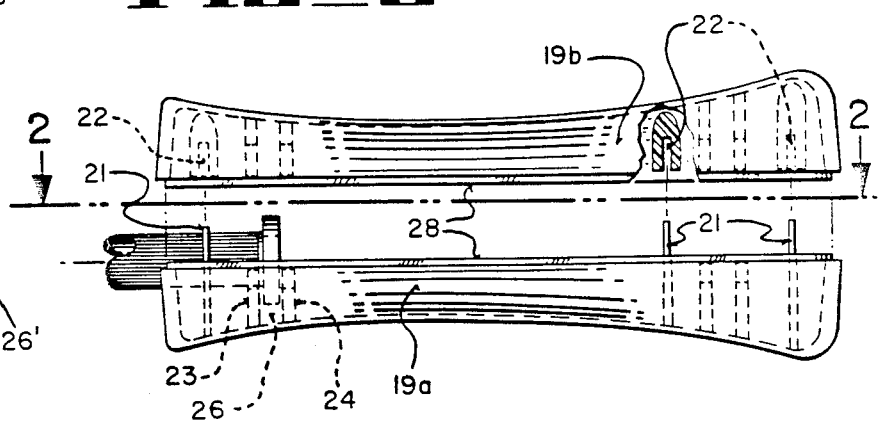
FIG. 3 shows an elevation exploded view with a portion broken away for clarity of a handle assembly for use on the skipping rope assembly of FIG. 1.

The exterior of element 11 is scored lengthwise as shown in region 12 (FIG. 2) in order to permit element 11 to flex more easily.

Figure 5:
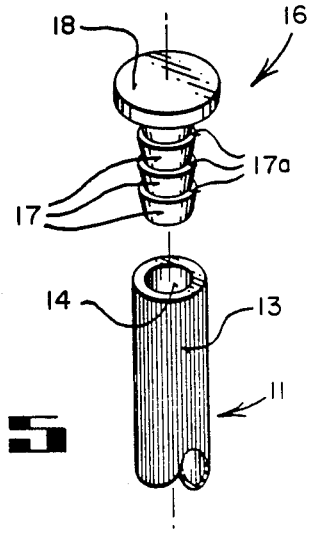
FIG. 5 shows an exploded perspective view of a stud disposed for entry into and attachment to the end of the skipping element of the skipping assembly shown in FIG. 1.

The ends of element 11 form a hollow tubular body 13 (FIG. 5) with openings 14 leading axially inwardly of such body 13. Retaining studs 16 attach to the ends of element 11 as now to be described.

Studs 16 include an elongate shank portion formed to include a sequence of tapered conical steps 17 disposed along the shank and oriented in a manner to more easily enter the open end of the tubular body 13 than to withdraw from body 13. Studs 16 include a circular (rounded) head portion 18, preferably of circular configuration. Thus, the edges 17*a* of steps 17 engage the inner wall surface of body 13 to inhibit removal.

Handle assemblies 19 include a pair of elongate hollow shell portions 19*a*, 19*b*. Shell portions 19*a*, 19*b* respectively have male and female means disposed for mutual engagement to retain said portions fitted together to form a hollow handle. Thus, shell portion 19*a* includes a group of six pins 21 formed integrally with portion 19*a* and aligned to enter a corresponding one of six sockets 22. The handles include a pair of axially spaced transverse walls 23, 24 or 23' or 24' defining a pocket 26, 26' respectively for receiving the head 18 of stud 16. One end of each of the handles includes an opening 27 disposed axially thereof for freely passing an end of element 11 therethrough and to permit it to rotate therein.

Figure 4:
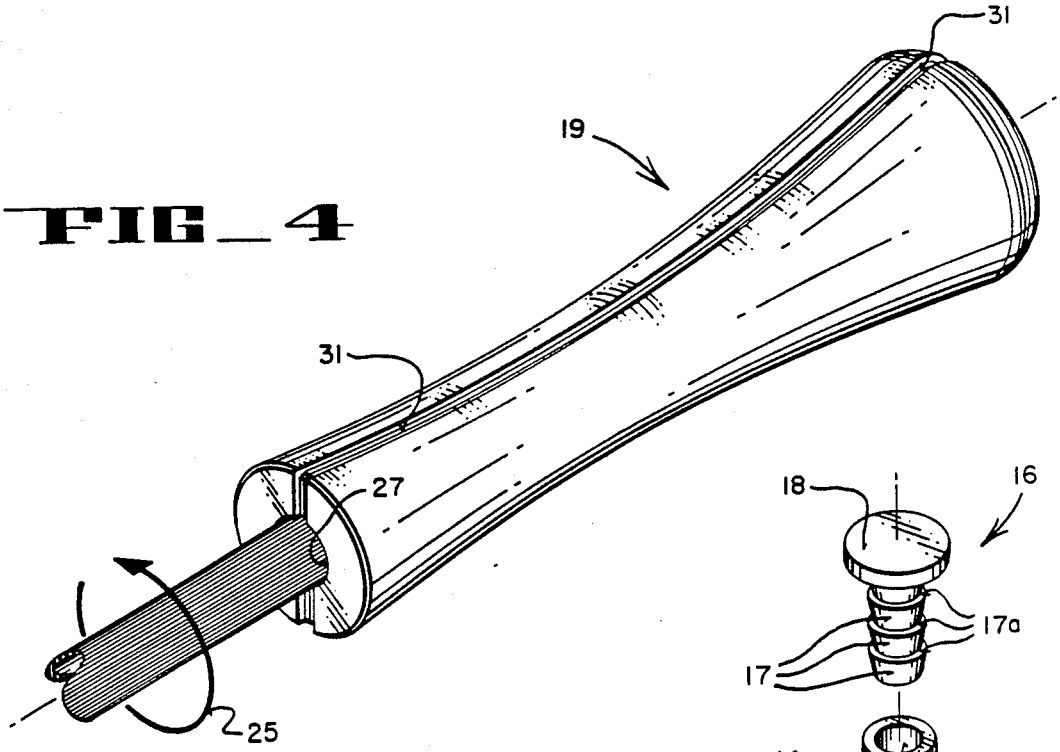
FIG. 4 shows a diagrammatic perspective view of a handle assembly to be carried from the end of a skipping rope assembly according to the invention.

In addition, wall 23 of pocket 26 includes a corresponding opening disposed therethrough for passing the skipping element 11 while permitting stud 16 and element 11 to rotate with respect to handle 19 as noted by arrow 25 (FIG. 4).

In addition, each shell portion 19*a*, 19*b* includes a narrow rim 28 extending around and protruding substantially normally from the upper edge of the shell. Rims 28 of shell portions 19*a*, 19*b* contact each other to form a spacer wall 29 disposed between each pair of shell portions 19*a*, 19*b* when the shell portions are mutually engaged and held together. Spacer wall 29 lies recessed in a groove 31 formed between the pair of shell portions.

By recessing the location of rims 28, the point where the two shells contact each other will be protected away from the skin of a person's hand holding or squeezing the handle. Thus, if the handle should be slightly spread apart when a person grips the handle, the skin on the person's hand cannot get caught between the two contacting edges of rims 28.

Figure 6:
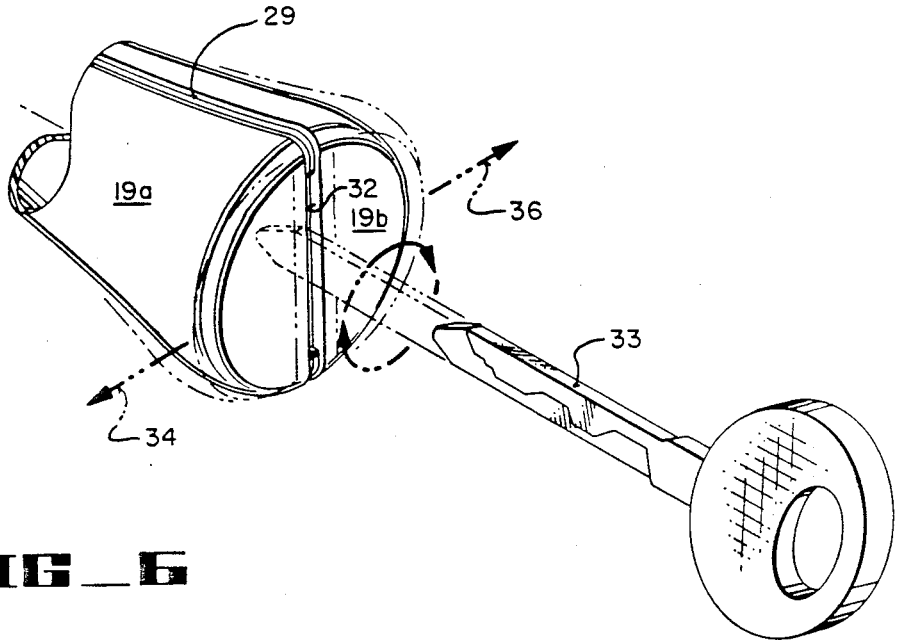
FIG. 6 shows a diagrammatic exploded perspective view of the rear end of the handle assembly and means for separating the two halves of the handle assembly according to the invention.

Further, means for readily separating the shell portions 19*a*, 19*b* from each other includes a slot or gap 32 (FIGS. 2, 6) formed through the spacer wall defined by the contacting rims 28. Gap 32 has sufficient width and height to receive a thin flat article, such as an automobile key 33, a coin, or the like, inserted therein in a manner to be twisted to force the shell portions apart. Thus, as shown best in FIG. 6, the outer end of handle 19 includes the slot 32 for receiving an automobile key 33 inserted therein. When key 33 is twisted, shell portions 19*a*, 19*b* spread laterally apart as indicated by the arrows 34, 36.

Figure 1:
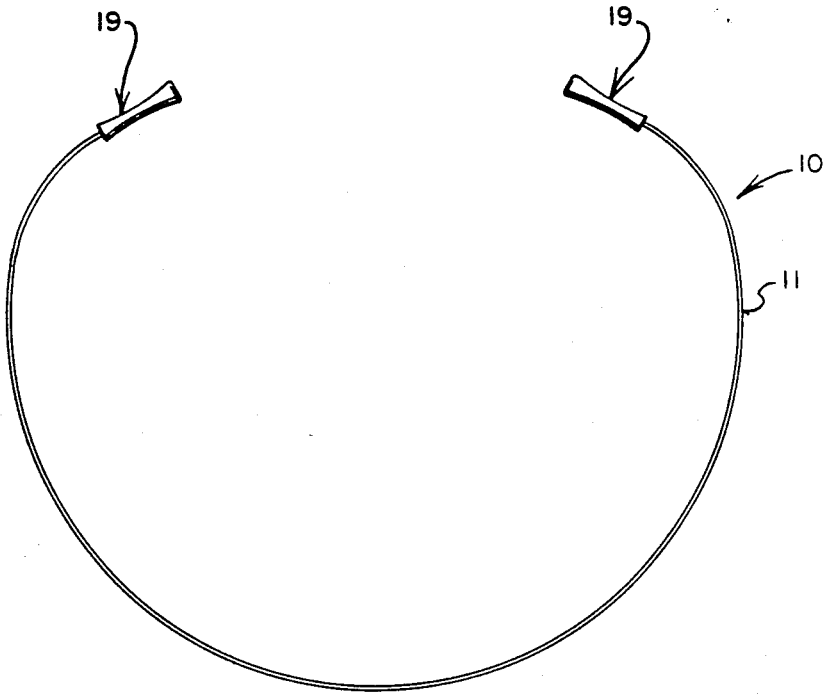
FIG. 1 shows an elevation view of a skipping rope assembly, according to the invention.

Means for adjusting the length of skipping element 11 includes a plurality of pockets 26 formed as described above to include a pair of axially spaced transversely extending planar walls defining a pocket therebetween for receiving the head portion 18 of stud 16 captured therein. Accordingly, by disposing head portion 18 of stud 16 in the bottom pocket, (as shown in FIG. 1), the active length of skipping element 11 will be shortened a minimum distance as defined between the two pockets.

Assuming that both handles 19 include a pair of such pockets available for use, maximum shortening of the skipping element 11 can be achieved by disposing head portion 18 in the pocket 26' which is farthest from opening 27 through the end of handle 19. Intermediate adjusting of the length of element 11 can be achieved by disposing one of the heads 18 in the remote pocket and the other in the leading pocket.

Accordingly, in the foregoing way the length of the skipping element 11 can be readily adjusted.

From the foregoing it will be readily evident that there has been provided an improved skipping element in which a small child or a person who is somewhat impaired can more readily control the motion of the skipping element as it is swung around the user. In addition, the length of the skipping assembly can be adjusted by opening or separating the two portions of either or both of the handles and relocating the end of the skipping element 11 within one or both handles.

Finally, in order to readily separate the two portions of either handle, a slot 32 is formed in the outer end of the handles to receive a flat, rigid article passed therethrough and capable of being twisted to spread the two portions apart.

From the foregoing, it will be readily evident that there has been provided an improved skipping assembly characterized by the foregoing features.

I claim:

1. In a skipping rope assembly of a type including an elongate skipping element, a hollow tubular body portion at the ends of said element, openings leading inwardly axially of each said body portion, handles carried at the ends of said element in a manner permitting said element to rotate within and with respect to said bodies while restraining the ends of said element against lengthwise movement within each said handle, said handles including a pair of elongate shell portions, said shell portions of each said handle respectively having means disposed to mutually and readily releasably engage so as to readily releasably retain said portions joined together to form a hollow handle, said shell portions including a peripheral side wall extending therearound and including an upper edge surface thereto, a narrow rim extending around and protruding upwardly from said upper edge of said side wall of at least one of said shell portions, said rims of said shell portions being disposed to engage each other to form a spacer wall between said shell portions when said portions are mutually engaged and held together, and means for readily separating said shell portions, the last named means including a gap formed through said spacer wall having sufficient width and height to receive a thin flat article inserted thereinto be twisted to force said shell portions apart.

2. In a skipping rope assembly of a type including an elongate skipping element, a hollow tubular body portion disposed at the ends of said element, openings leading axially inwardly of each said body portion, handles carried at the ends of said element in a manner permitting said element to rotate within and with respect to said body portions, studs carried by said tubular bodies and formed to have a sequence of tapered conical steps disposed therealong and oriented to more easily enter the open end of said tubular body portion than to withdraw from said tubular body portion, said studs having a broad head portion for retaining said element in an associated one of said handles, said handles including a pair of elongate shell portions, said shell portions of each said handle being formed to include a pair of axially spaced pockets for receiving the head of one of said studs selectively within one or the other of said pair of pockets so as to adjust the length of said skipping element.

* * * * *